US010297898B2

(12) United States Patent
Van Cleave

(10) Patent No.: US 10,297,898 B2
(45) Date of Patent: May 21, 2019

(54) ELECTRONIC DEVICE WITH ANTENNA INTEGRATED CONNECTOR SHROUD FOR WIRELESS COMMUNICATION OF DIAGNOSTICS

(71) Applicant: Netgear, Inc., San Jose, CA (US)

(72) Inventor: Todd Van Cleave, San Marcos, CA (US)

(73) Assignee: Netgear, Inc., San Jose, CA (US)

( * ) Notice: Subject to any disclaimer, the term of this patent is extended or adjusted under 35 U.S.C. 154(b) by 167 days.

(21) Appl. No.: 15/373,672

(22) Filed: Dec. 9, 2016

(65) Prior Publication Data

US 2018/0166768 A1 Jun. 14, 2018

(51) Int. Cl.

| | |
|---|---|
| ***H01Q 1/32*** | (2006.01) |
| ***H01Q 1/22*** | (2006.01) |
| ***H01Q 1/38*** | (2006.01) |
| ***H01Q 1/36*** | (2006.01) |
| ***H01Q 21/28*** | (2006.01) |
| ***H01Q 5/371*** | (2015.01) |

(52) U.S. Cl.

CPC ..... *H01Q 1/2291* (2013.01); *H01Q 1/3291* (2013.01); *H01Q 1/36* (2013.01); *H01Q 1/38* (2013.01); *H01Q 5/371* (2015.01); *H01Q 21/28* (2013.01)

(58) Field of Classification Search

CPC .. H01Q 1/2291; H01Q 1/3208; H01Q 1/3233; H01Q 1/243; G07C 5/0808

See application file for complete search history.

(56) References Cited

U.S. PATENT DOCUMENTS

| | | | | |
|---|---|---|---|---|
| 2010/0156726 | A1* | 6/2010 | Montgomery | H01Q 7/00 343/700 MS |
| 2013/0045697 | A1* | 2/2013 | Cheng | H04B 1/3838 455/95 |
| 2014/0300518 | A1* | 10/2014 | Ramachandran | H01Q 1/243 343/702 |
| 2016/0056529 | A1* | 2/2016 | Yi | H01Q 1/243 343/702 |
| 2016/0071333 | A1* | 3/2016 | Haidar | G07C 5/006 701/29.3 |
| 2016/0084657 | A1* | 3/2016 | Schilling | G01C 21/20 701/29.1 |
| 2016/0218422 | A1* | 7/2016 | Choi | H01Q 1/38 |

* cited by examiner

*Primary Examiner* — Hoang V Nguyen
*Assistant Examiner* — Awat M Salih
(74) *Attorney, Agent, or Firm* — Boyle Fredrickson, S.C.

(57) ABSTRACT

The subject matter disclosed herein describes integrating an antenna with a connector shroud of an electronic device used for conducting diagnostics. By integrating the antenna with the connector shroud, the device can be made smaller while still allowing for effective communication of results wirelessly to a remote system. In implementations such as On-board Diagnostics (OBD) II for motor vehicles, this may allow the device to remain present in the vehicle, conveniently while driving, for continuous monitoring and diagnostic feedback to a remote system, by consuming the least amount of space which may be needed by the driver.

20 Claims, 5 Drawing Sheets

ELECTRONIC DEVICE WITH ANTENNA INTEGRATED CONNECTOR SHROUD FOR WIRELESS COMMUNICATION OF DIAGNOSTICS

BACKGROUND OF THE INVENTION

1. Field of the Invention

The present invention relates to electronic devices for conducting diagnostics, and more particularly, to an electronic device having an antenna element integrated with a connector in which the connector allows connection for conducting the diagnostics and the antenna element allows wirelessly communicating results of the diagnostics and methods for manufacturing the same.

2. Discussion of the Related Art

Many electronic devices currently available for conducting diagnostics. One such device is an On-Board Diagnostics (OBD) device for use in motor vehicle applications. Such OBD devices typically have a connector for connecting to a port in the vehicle, typically under the dashboard near the steering wheel, for accessing electrical systems of the vehicle and retrieving useful information for technicians. Such information may include, for example, diagnostic trouble codes which may be useful for quickly identifying and remedying malfunctions of the vehicle, engine performance settings, emission levels, and the like. Such devices may also further interact with the electrical system, such as by clearing the diagnostic trouble codes or adjusting performance settings.

Advancements in OBD devices, such as the OBD II improvement and wireless OBD II, have enabled improved monitoring capabilities. OBD II specifies a type of diagnostic connector and pinout, electrical signaling protocols, and messaging format, among other things. Wireless OBD II provides antennas for communicating results of the diagnostics to a remote computer system, such as a tablet or smartphone. However, despite such improvements, OBD devices remain large, particularly if they include multiple antennas for cellular data communication, and are therefore obtrusive to drivers. For example, despite an OBD device having wireless communication capability, when connected to the port in the vehicle, the size and shape of the device may cause interference with the driver's legroom. Consequently, many drivers may opt to disconnect the device from the vehicle while driving, thereby limiting any advantages the device may provide. What is needed is an improved electronic device for conducting diagnostics that eliminates one or more of the foregoing disadvantages.

SUMMARY OF THE INVENTION

The subject matter disclosed herein describes integrating an antenna with a connector shroud of an electronic device used for conducting diagnostics. By integrating the antenna with the connector shroud, the device can be made smaller while still allowing for effective communication of results wirelessly to a remote system. In implementations such as On-board Diagnostics (OBD) II for motor vehicles, this may allow the device to remain present in the vehicle, conveniently while driving, for continuous monitoring and diagnostic feedback to a remote system, by consuming the least amount of space which may be needed by the driver.

Accordingly, the invention may take advantage of the large OBD II male connector housing in order to integrate (attach or print) one or more of the many antennas of the device directly onto the connector housing. This may reduce the overall size of the cellular data enabled device, improve antenna to antenna isolation, allow for additional antennas and/or communication abilities, and/or provide a unique and/or stylized connector which may be visually pleasing and/or identifiable by consumers. Moreover, in the case of OBD II, the size of the device may be constrained to minimize impact to the driver's compartment.

In one aspect, antenna copper patterns may wrap around the exterior of the OBD II male connector. This may constitute one of multiples antennas which may be used to support wireless Wide Area Networks (WAN), Local Area Networks (LAN) and/or other radios inside of the device.

By using the available space on the exterior of the connector housing for one or more antenna(s), the overall size of the device may be directly reduced by the volume these antennas would require if placed internally to the device. The allows for a smaller overall product size, with potentially larger, better performing antennas, than would be available with existing designs where all of the antennas must be included inside the device housing.

In the case of OBD II device form factor, the smaller a device can be made, the greater number of vehicles it can be installed into without causing one or more of: an operational impairment; physical interference with a driver's legs or feet, such as during vehicle operation, ingress or egress; physical prevention or complication of a driver's ability to enter or exit the vehicle; and/or damage to the host vehicle's OBD II connector which might occur when an OBD II device is struck by a swinging leg or foot.

Antenna elements, if exposed, can be further optimized to produce more visually pleasing designs. Plating options may enable visually different color options or nearly invisible implementations. Antenna elements may also be wrapped with an additional layer of material, such as plastic, Mylar, Kapton, paint, or the like, to further reduce obviousness. Insert molded options could also be provided in which the antenna element is physically captured within the OBD II connector plastics to be largely invisible to the user.

In one aspect, a single dual band antenna element may have an antenna feed located in the center of the device, a low band element to a first side (which may be a longer element), and high band element on a second side (which may be a shorter element). The feed location could be in any location, and the number of antennas, and/or number of bands supported may vary depending on the internal radio's capability and/or the communication carrier's requirements.

Specifically then, one aspect of the present invention may provide an electronic device for wireless diagnostics including: a PCB; one or more electronic components mounted to the PCB; an electrical connector mounted to the PCB, the electrical connector having a plurality of electrical conductors surrounded by a shroud, the electrical conductors being in communication with the one or more electronic components; and first and second antenna elements in communication with the one or more electronic components, in which the first antenna element is integrated with the PCB, and the second antenna element is integrated with the shroud.

Another aspect of the present invention provides a method for manufacturing an electronic device for wireless diagnostics. The method may include: mounting one or more electronic components to a PCB; mounting an electrical connector to the PCB, the electrical connector having a plurality of electrical conductors surrounded by a shroud, in which the electrical connector is mounted to the PCB to be in communication with the one or more electronic components; integrating a first antenna element with the PCB, in which the first antenna element is integrated with the PCB to be in communication with the one or more electronic components; and integrating a second antenna element with the shroud, in which the second antenna element is integrated with the shroud to be in communication with the one or more electronic components.

These and other features and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

Figure 1:
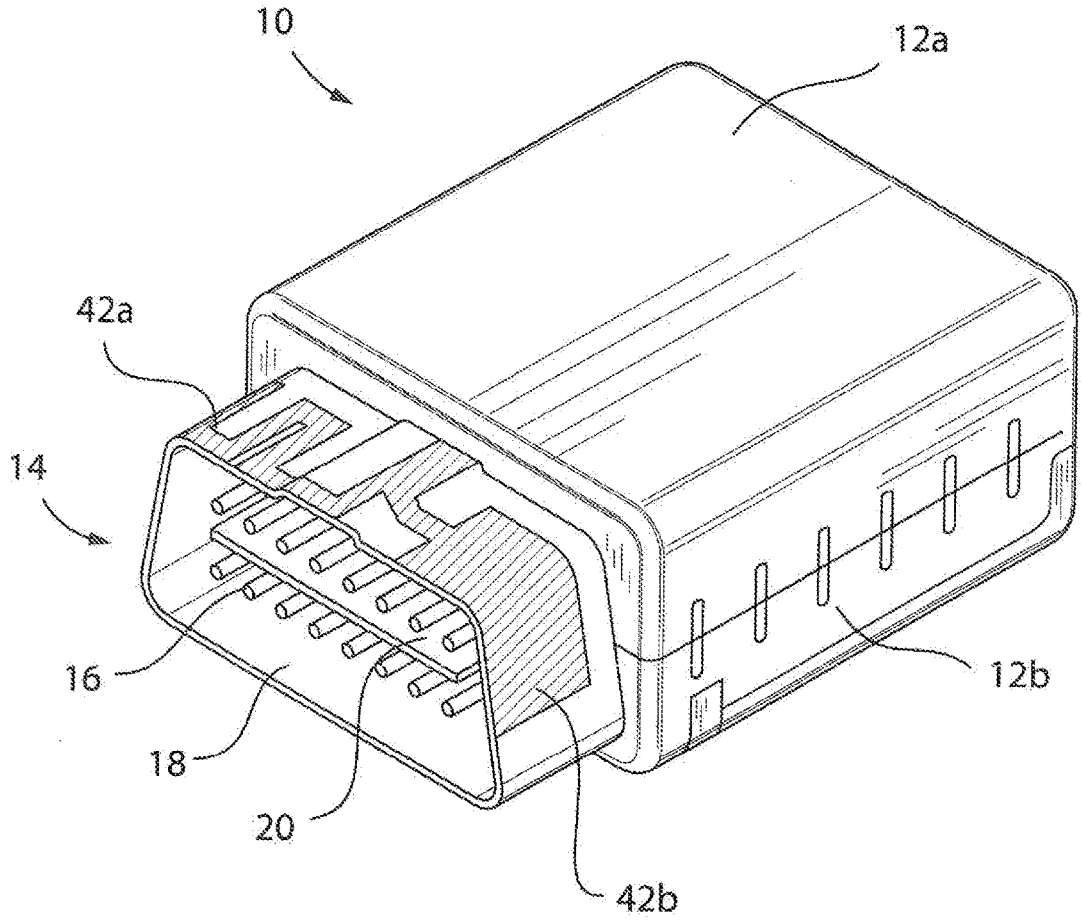
FIG. 1 is an isometric view of an electronic device for wireless diagnostics having an antenna integrated with a connector shroud in accordance with an aspect of the invention.

Referring now to FIG. 1, in accordance with an aspect of the invention, an electronic device 10 may be provided for conducting diagnostics and otherwise interacting with an electrical system. The device 10 may include a housing 12, which in one aspect may include first and second housing halves 12*a* and 12*b*, respectively, joined together for enclosing a Printed Circuit Board (PCB) therein (shown in FIG. 5).

Figure 2:
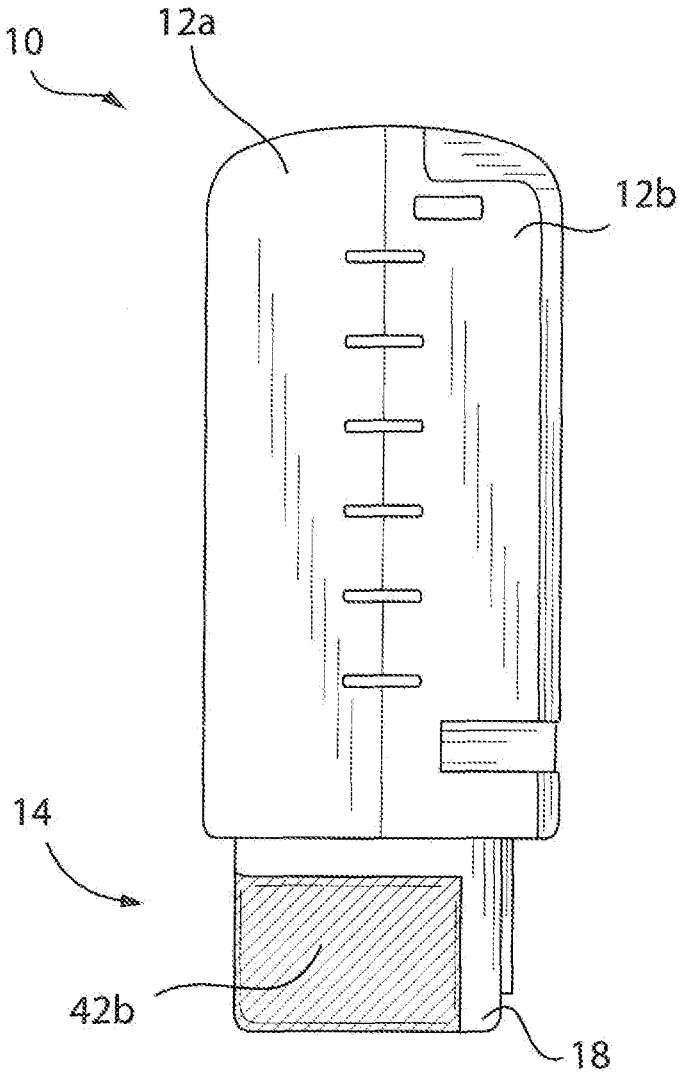
FIG. 2 is a first side view of the device of FIG. 1.
Figure 3:
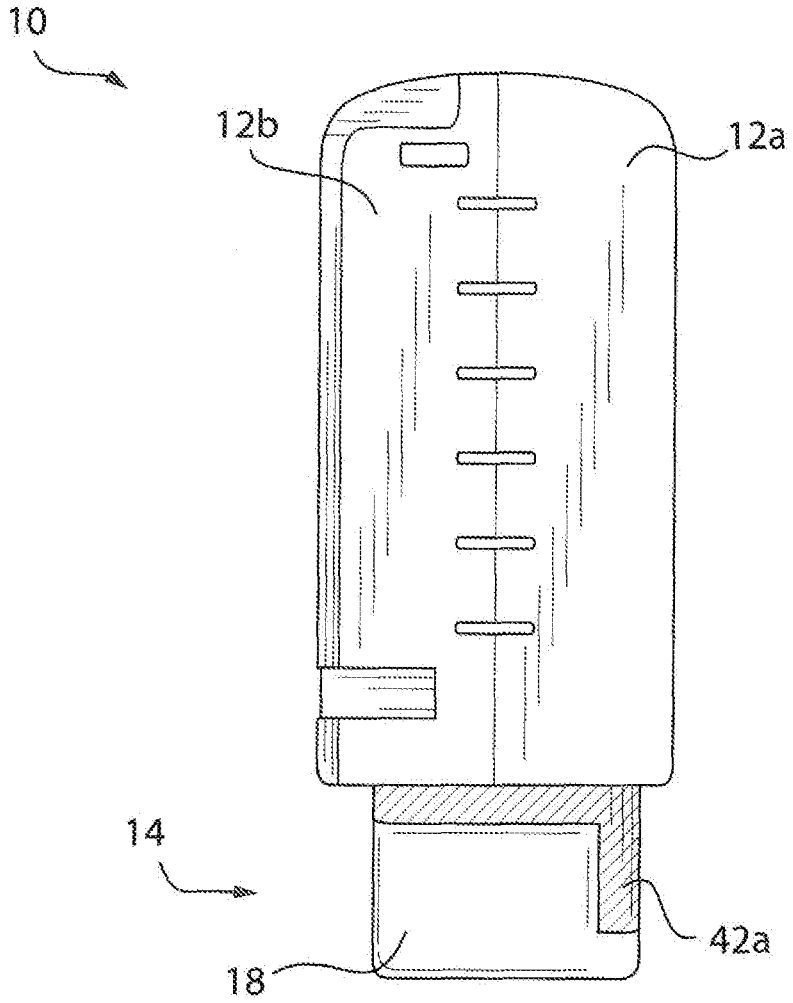
FIG. 3 is a second side view of the device of FIG. 1.

The device 10 may also include a connector 14 for connecting to an electrical system. The connector 14 may include multiple electrical conductors 16 which may provide power, ground, input and/or output (I/O) signal connections with the electrical system. The electrical conductors 16 may be surrounded by a shroud 18, which may be configured to fit over a port of an electrical system (shown in FIG. 4) for ensuring a stable connection to the port. The connector 14 may also include a key 20, which may be disposed between the electrical conductors 16, for guiding connection of the electrical conductors 16 to the port. The connector 14 may be shaped to ensure correct orientation of the device 10 with respect to the port, such as substantially trapezoidal as shown in FIG. 1, though in other embodiments, differing shapes and configurations may be used. FIGS. 2 and 3 provide first and second side views, which are alternating side views, of the device 10.

Figure 4:
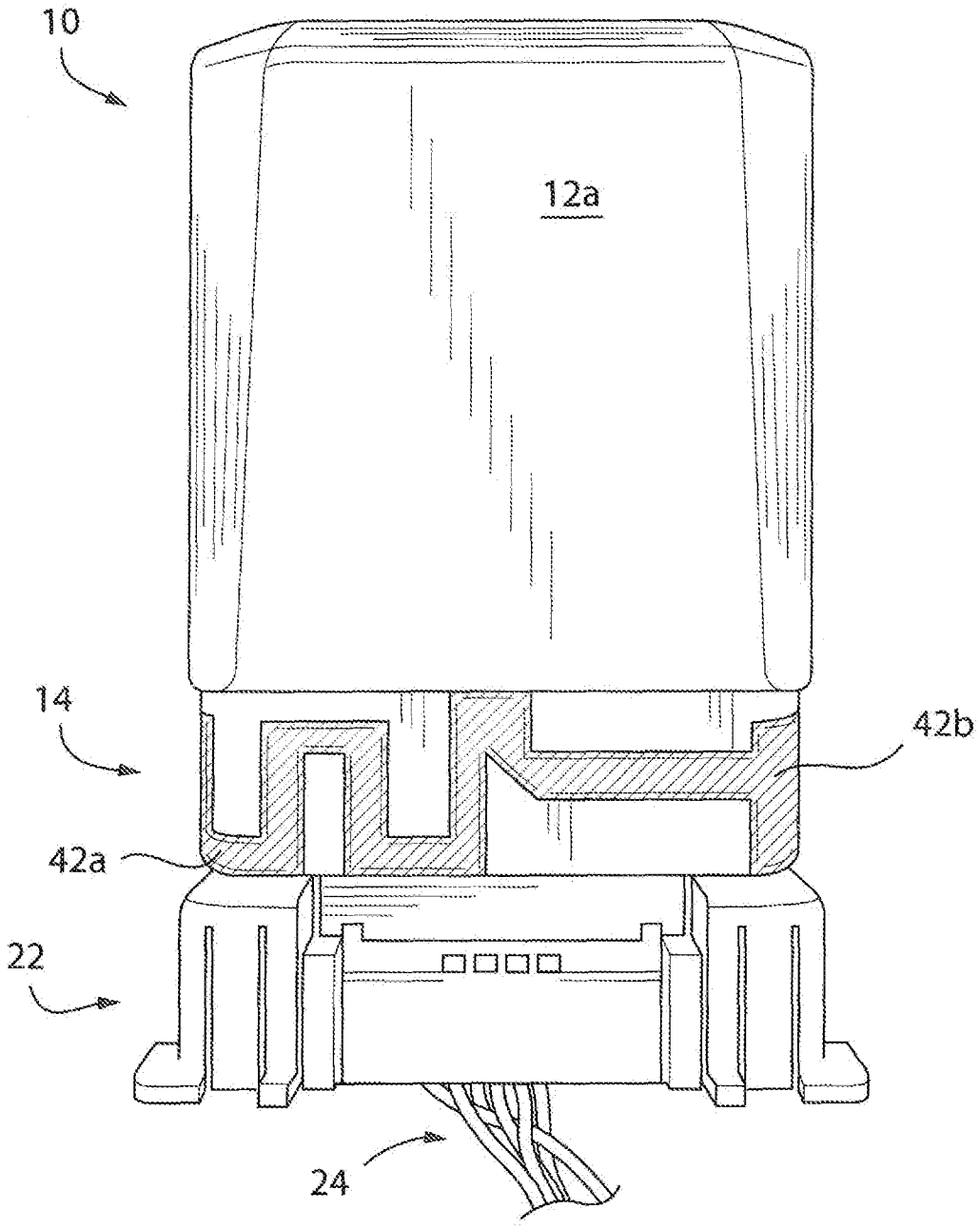
FIG. 4 is an isometric overhead view of the device of FIG. 1 connected to a port for conducting diagnostics in accordance with an aspect of the invention.

With additional reference to FIG. 4, in one aspect, the device 10 may be an On-board Diagnostics (OBD) II device for use in motor vehicle applications. Accordingly, the connector 14 may be an OBD II compliant male connector for connecting to a port 22 in the vehicle for accessing electrical systems of the vehicle, via wiring 24. The device 10 may then be used to retrieve useful information, provide continuous monitoring, clear diagnostic trouble codes, adjust performance settings and/or otherwise interact with the vehicle.

Figure 5:
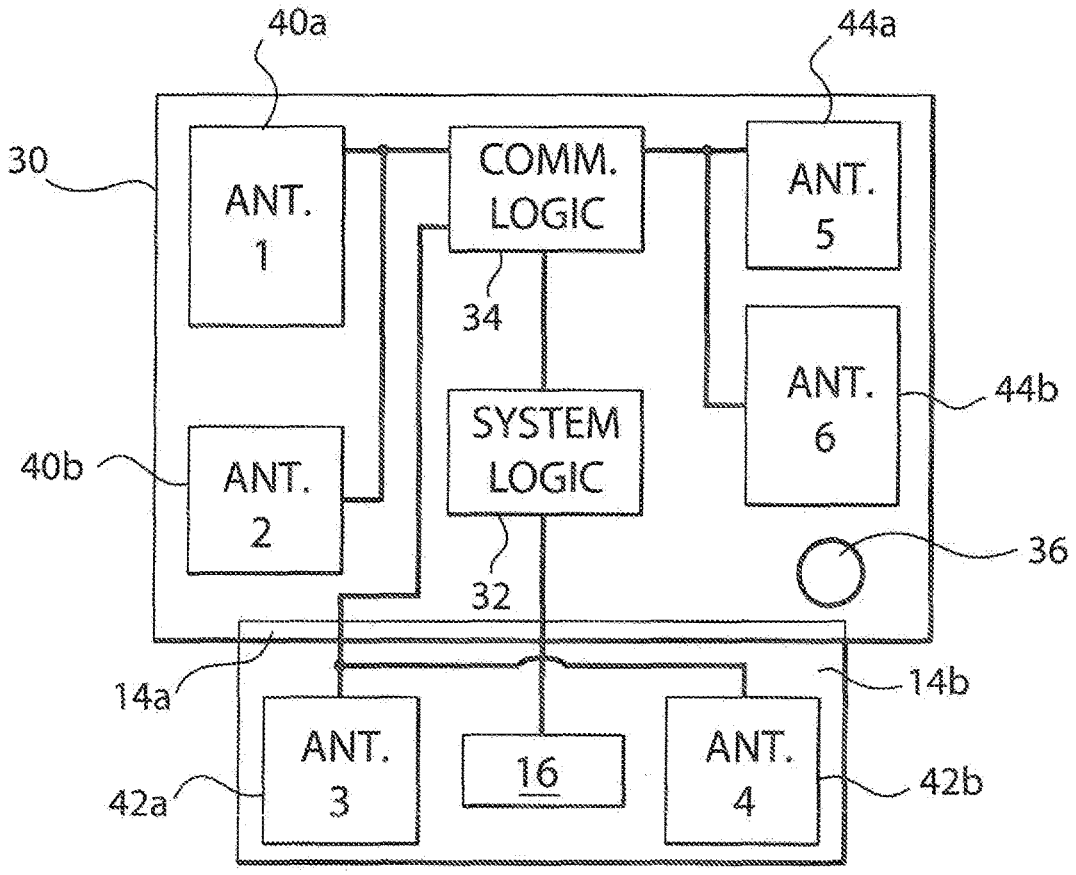
FIG. 5 is an exemplar circuit diagram for implementing the device of FIG. 1.

Referring now to FIG. 5, in accordance with an aspect of the invention, the device 10 may include a PCB 30 and one or more electronic components mounted to the PCB 30, such as system logic 32 and communications logic 34. The electronic components may include integrated circuits of various levels of integration and/or other elements and may be in electrical communication with one another. The connector 14 may be mounted to the PCB 30 so that one or more of the electrical conductors 16 are in communication with, the system logic 32. The housing 12 may enclose the PCB 30, the one or more electronic components and an inner portion of the connector 14*a*, while an outer portion of the connector 14*b* and the electrical conductors 16 may be externally accessible through the housing 12 (such as for connection to the port 22). The system logic 32 and the communications logic 34 may receive power from the electrical system, such as upon connection to the port 22. In addition, or alternatively, the system logic 32 and/or the communications logic 34 may receive power from an on-board battery 36 installed on the PCB 30. Accordingly, the system logic 32 may communicate with the electrical system for conducting diagnostics, such as to implement OBD II functionalities as known in the art.

To implement wireless communication for the device 10, such as to send results of the diagnostics or receive commands, the communications logic 34 may be in communication with multiple antennas. In one aspect, the communications logic 34 may be in communication with: a first antenna element, which may include a first antenna segment 40*a* ("Antenna 1") and a second antenna segment 40*b* ("Antenna 2"); a second antenna element, which may include a first antenna segment 42*a* ("Antenna 3") and a second antenna segment 42*b* ("Antenna 4") and a third antenna element, which may include a first antenna segment 44*a* ("Antenna 5") and a second antenna segment 44*b* ("Antenna 6"). Accordingly, the communications logic 34 may provide feed points, which may be in any location, for each of the aforementioned antenna elements to implement Multiple Input and Multiple Output (MIMO) radiofrequency (RF) communications using various frequencies and protocols via multi band antennas. For example, as shown in FIGS. 1-5, the second antenna element may be a dual band antenna in which the first antenna segment 42*a* is longer and narrower than the second antenna segment 42*b*, so that the first antenna segment 42*a* may provide a lower frequency band for communication than the second antenna segment 42*b* when driven by the communications logic 34.

In accordance with an embodiment of the invention, the first and third antenna elements (Antennas 1, 2, 5 and 6) may be copper segments integrated with the PCB 30, and may therefore be enclosed by the housing 12. The first and third antenna elements may provide Wide Area Network (WAN) communication for the device 10, such as cellular data communication via GSM, UMTS, LTE and/or WiMAX frequency bands, among others, to implement 4×4 MIMO wireless WAN communications. In addition, the second antenna element (Antennas 3 and 4) may be copper antenna segments integrated with the shroud 18 of the connector 14, and may therefore be external to the housing 12. The second antenna element may provide Local Area Network (LAN) communication for the device 10, such as Ethernet and/or Wi-Fi at corresponding frequency bands, among others, to implement 2×2 MIMO wireless LAN communications. Alternative embodiments may include greater or fewer antennas, varying configurations of communication protocols and frequencies, and/or varying configurations of communications of logic for feeding and monitoring the antennas, without departing from the scope of the invention.

As a result, by integrating the second antenna element with the connector 14, the device 10 may achieve communication functionality provided by the second antenna element with a reduced size of the housing 12. This may allow the device 10 to remain present in a vehicle conveniently while driving, for example, for continuous monitoring and diagnostic feedback to a remote system, by consuming the least amount of space which may be needed by the driver. This may also allow reducing the overall size of the device 10 by the volume that the second antenna element would require if placed internally.

Figure 6:
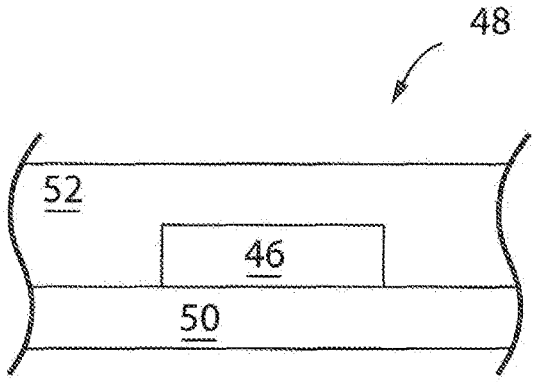
FIG. 6 is an exemplar cutaway side view of an antenna integrated with a connector shroud in accordance with an aspect of the invention.

Referring now to FIG. 6, an exemplar cutaway side view of an antenna segment 46 which may be integrated with a shroud 48 of a connector is provided in accordance with an aspect of the invention. For manufacturing the antenna segment 46 with the shroud 48, a first layer 50 of the shroud 48 may be provided. The first layer 50 may be a plastic injection molded layer or similar layer for constructing a connector as known in the art. Next, the antenna segment 46 may be integrated with the first layer 50 by wrapping the antenna segment 46 over the first layer 50 in a design configuration pattern as may be desired. The antenna segment 46 may optionally be adhered to the first layer 50 using adhesives known in the art. Next, a second layer 52 of the shroud 48 may be provided. The second layer 52 may also be a plastic injection molded layer or similar layer for constructing the connector as known in the art so that antenna segment 46 is largely invisible to the user. However, alternatively, the second layer 52 may comprise plating with paint, plastic. Mylar and/or Kapton, so as to reduce obviousness of the antenna segment 46, or enhance decoration by displaying the antenna segment 46, as may be desired.

Although the best mode contemplated by the inventors of carrying out the present invention is disclosed above, practice of the above invention is not limited thereto. It will be manifest that various additions, modifications and rearrangements of the features of the present invention may be made without deviating from the spirit and the scope of the underlying inventive concept.

It should be appreciated that such a development effort might be complex and time consuming, but would nevertheless be a routine undertaking of design, fabrication, and manufacture for those of ordinary skill having the benefit of this disclosure. Nothing in this application is considered critical or essential to the present invention unless explicitly indicated as being "critical" or "essential."

What is claimed is:

1. An electronic device for wireless diagnostics comprising:

a Printed Circuit Board (PCB);

one or more electronic components mounted to the PCB;

an electrical connector mounted to the PCB, the electrical connector having a plurality of electrical conductors surrounded by a connector shroud, the electrical conductors being in communication with the one or more electronic components; and first and second antenna elements in communication with the one or more electronic components, wherein the first antenna element is integrated with the PCB, and the second antenna element is integrated with the connector shroud.

2. The electronic device of claim 1, further comprising a housing enclosing the PCB, wherein the electrical conductors of the electrical connector are externally accessible through the housing.

3. The electronic device of claim 2, wherein the electrical connector is a male On-board Diagnostics (OBD) II connector.

4. The electronic device of claim 3, wherein the one or more electronic components include system logic and communications logic, wherein the system logic is in communication with one or more of the electrical conductors for implementing OBD II and the communications logic is in communication with the first and second antenna elements for implementing radiofrequency (RF) communication.

5. The electronic device of claim 4, wherein the communications logic is in communication with the first antenna element for Wide Area Network (WAN) communication and the communications logic is in communication with the second antenna element for Local Area Network (LAN) communication.

6. The electronic device of claim 5, wherein the first antenna element includes first and second antenna segments for Multiple Input and Multiple Output (MIMO) communication over WAN, and the second antenna element includes first and second antenna segments for MIMO communication over LAN.

7. The electronic device of claim 6, further comprising a third antenna element in communication with the communications logic, wherein the third antenna element is integrated with the PCB, and wherein the third antenna element includes first and second antenna segments for the MIMO communication over WAN.

8. The electronic device of claim 1, wherein the second antenna element is a dual band copper antenna having first and second antenna segments.

9. The electronic device of claim 8, wherein the first antenna segment is longer and narrower than the second antenna segment and the first antenna segment provides a lower frequency band for communication than the second antenna segment.

10. The electronic device of claim 1, wherein the connector shroud comprises first and second layers, and wherein the second antenna element is integrated between the first and second layers.

11. The electronic device of claim 10, wherein the first and second layers are plastic injection molded layers.

12. The electronic device of claim 10, wherein the first layer is a plastic injection molded layer and the second layer provides plating.

13. A method for manufacturing an electronic device for wireless diagnostics, the method comprising:

mounting one or more electronic components to a Printed Circuit Board (PCB);

mounting an electrical connector to the PCB, the electrical connector for externally connecting the device to a port, the electrical connector having a plurality of electrical conductors surrounded by a connector shroud, wherein the electrical connector is mounted to the PCB to be in communication with the one or more electronic components;

integrating a first antenna element with the PCB, wherein the first antenna element is integrated with the PCB to be in communication with the one or more electronic components; and integrating a second antenna element with the connector shroud, wherein the second antenna element is integrated with the connector shroud to be in communication with the one or more electronic components.

14. The method of claim 13, further comprising enclosing the PCB within a housing, wherein the electrical conductors of the electrical connector are externally accessible through the housing.

15. The method of claim 13, further comprising integrating the second antenna element between first and second layers of the connector shroud.

16. The method of claim 15, further comprising plastic injection molding the first and second layers.

17. The method of claim 15, further comprising plastic injection molding the first layer and plating the second layer.

18. The method of claim 13, wherein integrating the second antenna element with the connector shroud includes wrapping the second antenna element around the connector shroud.

19. The method of claim 13, wherein the electrical connector is a male On-board Diagnostics (OBD) II connector.

20. The method of claim 13, wherein the first antenna element includes first and second antenna segments for MIMO communication over WAN and the second antenna element includes first and second antenna segments for MIMO communication over LAN.

* * * * *